US008993501B2

(12) United States Patent
Singh

(10) Patent No.: US 8,993,501 B2
(45) Date of Patent: Mar. 31, 2015

(54) SPRAYABLE GEL CLEANER FOR OPTICAL AND ELECTRONIC SURFACES

(75) Inventor: Brij P. Singh, North Royalton, OH (US)

(73) Assignee: Visichem Technology, Ltd., North Royalton, OH (US)

( * ) Notice: Subject to any disclaimer, the term of this patent is extended or adjusted under 35 U.S.C. 154(b) by 364 days.

(21) Appl. No.: 13/482,235

(22) Filed: May 29, 2012

(65) Prior Publication Data

US 2013/0032168 A1 Feb. 7, 2013

Related U.S. Application Data

(60) Provisional application No. 61/513,777, filed on Aug. 1, 2011.

(51) Int. Cl.

| | |
|---|---|
| ***C11D 17/00*** | (2006.01) |
| ***C11D 3/00*** | (2006.01) |
| ***C11D 11/00*** | (2006.01) |

(52) U.S. Cl.

CPC ..... *C11D 17/003* (2013.01); *C11D 3/0078* (2013.01); *C11D 11/0035* (2013.01)

USPC ..... 510/180

(58) Field of Classification Search

CPC ..... C11D 17/003

USPC ..... 510/403, 406, 432

See application file for complete search history.

(56) References Cited

U.S. PATENT DOCUMENTS

| | | | |
|---|---|---|---|
| 3,249,550 | A | 5/1966 | Metters |
| 3,709,437 | A | 1/1973 | Wright |
| 3,779,929 | A | 12/1973 | Abler et al. |
| 3,937,364 | A | 2/1976 | Wright |
| 3,974,965 | A | 8/1976 | Miller |
| 4,002,351 | A | 1/1977 | Zuck |
| 4,184,615 | A | 1/1980 | Wright |
| 4,646,973 | A | 3/1987 | Focaracci |
| 5,220,483 | A | 6/1993 | Scott |
| 5,337,929 | A | 8/1994 | Van der Heijden |
| 5,364,031 | A | 11/1994 | Taniguchi et al. |

(Continued)

FOREIGN PATENT DOCUMENTS

| | | |
|---|---|---|
| JP | 2004-075791 | 3/2004 |
| WO | WO 97/13585 | 4/1997 |

OTHER PUBLICATIONS

International Search report and Written Opinion, dated Jun. 21, 2013 issued in connection with PCT/US2012/041584, filed Jun. 8, 2012.

Notification Concerning Transmittal of International Preliminary Report on Patentability, dated Feb. 4, 2014 issued in connection with PCT/US2012/041584, filed Jun. 8, 2012.

*Primary Examiner* — Gregory Webb

(74) *Attorney, Agent, or Firm* — Fay Sharpe LLP

(57) ABSTRACT

A sprayable homogeneous and high viscosity surface cleaning gel or gel foam composition and method of cleaning is provided. The composition may include from about 70% to about 99% of a liquid carrier; from about 0.002% to about 10% of surfactant selected from the group of non-ionic, anionic, amphoteric, and zwitterionic surfactants, and mixtures thereof; from about 0.005% to about 5% of a water-soluble polymeric thickening agent; and from about 0.001 to about 1.0% of a pH balancing agent. The sprayable gel cleaner composition may be completely clear without any suspended encapsulated particles in it and includes a viscosity range from about 200 centipoise to about 30,000 centipoise at standard temperature and pressure.

21 Claims, 2 Drawing Sheets

(56) References Cited

U.S. PATENT DOCUMENTS

| | | | | |
|---|---|---|---|---|
| 5,705,470 | A * | 1/1998 | Faris | 510/403 |
| 5,955,417 | A | 9/1999 | Taylor | |
| 5,977,050 | A | 11/1999 | Faris | |
| 6,030,931 | A | 2/2000 | Vinski et al. | |
| 6,264,964 | B1 | 7/2001 | Mohammadi | |
| 6,403,545 | B1 * | 6/2002 | Karls et al. | 510/181 |
| 6,497,866 | B2 | 12/2002 | Irrgang et al. | |
| 6,838,426 | B1 * | 1/2005 | Zeilinger | 510/417 |
| 6,881,273 | B1 | 4/2005 | Oberman | |
| 6,883,989 | B2 | 4/2005 | Kushner et al. | |
| 2002/0063054 | A1 | 5/2002 | Marshall | |
| 2003/0125224 | A1 | 7/2003 | Seitz et al. | |
| 2004/0034157 | A1 * | 2/2004 | Ghosh et al. | 524/556 |
| 2005/0067435 | A1 | 3/2005 | Gentile | |
| 2006/0046954 | A1 | 3/2006 | Smith et al. | |
| 2006/0116306 | A1 | 6/2006 | Patien et al. | |
| 2006/0241010 | A1 | 10/2006 | Boone et al. | |
| 2007/0117736 | A1 * | 5/2007 | Figger et al. | 510/421 |
| 2008/0149145 | A1 | 6/2008 | Singh | |

* cited by examiner

SPRAYABLE GEL CLEANER FOR OPTICAL AND ELECTRONIC SURFACES

This application claims priority from U.S. provisional application Ser. No. 61/513,777, filed Aug. 1, 2011, entitled "SPRAYABLE GEL CLEANER FOR OPTICAL AND ELECTRONIC SURFACES", which application is incorporated by reference herein in its entirety.

BACKGROUND

The present invention relates to a variable viscosity sprayable gel or gel foam cleaner composition and method for cleaning delicate and sensitive hydrophobic/super hydrophobic (hereon as "Hydrophobic") surfaces such as optical lenses and electronic devices. More particularly, the present invention relates to a completely homogeneous sprayable gel or gel foam cleaner composition and method of cleaning wherein the gel clings to and dwells for extended time on an optical lens or electronic surface when applied thereon. Preferably, the sprayable gel cleaner composition hereof is packed in a spray bottle dispenser, aerosol or non-aerosol foam pump, squeezable tube or flexible pouch.

Sprayable low viscosity and water based liquid cleaning compositions such as glass cleaners, all-purpose cleaners, bathroom cleaners and polishing cleaners as well as optical lens cleaners are known and are used by many people. In general, these commercially available cleaning compositions have low viscosity, and consequently, have a tendency to overspray and drip or run off from the surface to which they are applied, such as vertical windows, bathroom mirrors or horizontal ceiling. Similarly, problems are observed with the hydrophobic optical lenses and electronic surfaces using the liquid lens cleaners. These water or liquid based cleaners may have ammonia and glycol ether solvents and typically bead up on the surface, have no clinging ability or dwelling time, and easily roll off from the surface onto a perimeter of the surface. Therefore, very little contact is made with the liquid cleaner and the surface to be cleaned. This drip or run off of the low viscosity cleaning composition leads to inefficient cleaning and waste of product as well as wetting of non-targeted areas on the articles, such as eyeglass frames and electronic device housings etc.

As illustrated in FIG. 1, a prior art liquid spray bottle dispenser A is shown dispensing a liquid B from a spray head C onto a surface D to be cleaned. FIG. 1 illustrates that a user has reduced control over the amount of liquid B delivered by the spray bottle dispenser A as it comes in contact with the surface such as an optical lens or an electronic device. Because the cleaner B is delivered to the surface D as a liquid, the liquid rolls off the surface flowing onto other fixtures of the article (such as an eyeglass frame E, a camera lens housing, a computer screen frame, a cell phone housing, etc.). The dispensed liquid may also collect to form a pool F on the optical surface and drips G or spills onto associate objects H such as a book, table, desk, floor, clothes, etc. Excess or uncontrolled spray can cause blemishing I or respiratory irritation to the user.

Generally, optical lenses such as eyeglasses, sun and sports lenses, safety glasses, camera lenses, telescope lenses, microscope lenses, and electronic surfaces such as touch screens, digital displays, computer monitors, tablet displays, telephone displays, and TV screens are made of hydrophobic surfaces such as plastic, hard coated plastic, polycarbonate plastic, high index plastic as well as glass. These surfaces can also be covered with an anti-reflective film together with a hydrophobic coating thereon. These additional films and coatings help to prevent reflection as well as unwanted wetting with water based cleaners or liquid and can also help make the surface easy to clean any finger prints, smudges and other contaminants thereon. These surfaces have prompted us to develop gel or gel foam based cleaners to prevent excess waste and runoff.

In recent years, the sprayable cleaning gel compositions have been reported by Faris in U.S. Pat. Nos. 5,705,470 and 5,977,050. Faris has disclosed substantially homogeneous and particle free sprayable cleaning gel compositions with viscosity ranging from 900 centipoises (cP) to about 5,500 cP at standard temperature and pressure. Faris discloses a composition of different glycol ethers and certain dispersants as necessary parts of the composition together with other components in it. Faris claims improved clinging and dwell time on the surface to be cleaned such as glass, metal, and painted surfaces. In addition, Faris also claims improved surface contact with his cleaning compositions during cleaning of highly hydrophilic surfaces such as glass and metals. Notably, hydrophilic surfaces are water attracting or retaining surfaces that act to retain moisture. Faris does not disclose anything about anti-reflective hydrophobic lens surfaces or electronic surfaces. Also, Faris could only achieve an upper end viscosity with his composition as 5,500 cP using recommended water soluble polymeric thickeners in high amount up to 10 percent. The high concentration of thickeners may affect the cleaning efficiency of the gel cleaner on hydrophobic optical and electronic surfaces.

Another sprayable cleaning gel composition is reported by Fligger, in Pat. App. No. US 2007/0117736 A1. Fligger discloses a sprayable high viscosity thixotropic surface cleaner composition that also has glycol ethers in it. The sprayable thixotropic cleaner taught by Fligger has viscosity in the range of 6,000 cP to 25,000 cP and has encapsulated suspended insoluble and abrasive particles in it. The composition is more targeted to clean hard surfaces such as glass and metals. In addition, the thixotropic gel cleaner of Fligger becomes semisolid on the surface after spraying. The solid particles in the thixotropic semisolid gel cleaner may abrade and damage the delicate hydrophobic optical lens or electronic surface to be cleaned. Therefore, the gel cleaner disclosed by Fligger may be inefficient and damaging if used to clean delicate surfaces.

Many other different types of sprayable cleaning gel compositions and methods are available on the market for different surfaces and purposes. However, a need still exists for a sprayable gel or gel foam cleaner composition and method of cleaning, which is completely homogeneous, has a wide range of viscosity at room temperature and pressure, has no suspended encapsulated particles or glycol ether solvents and which clings and dwells for extended time on the hydrophobic optical lens or the electronic device surface when sprayed or applied in a controlled fashion as gel or gel foam. There is also a need for a cleaning composition with an improved cleaning efficiency that does not cause damage to the surface.

SUMMARY OF THE INVENTION

In one aspect of the disclosure, a sprayable, homogeneous and high viscosity surface cleaning gel composition is provided. The composition includes from about 70% to about 99% of a liquid carrier; from about 0.002% to about 10% of surfactant selected from the group of non-ionic, anionic, amphoteric, and zwitterionic surfactants, and mixtures thereof; from about 0.005% to about 5% of a water-soluble polymeric thickening agent; and from about 0.001 to about 1.0% of a pH balancing agent. The sprayable gel cleaner composition is completely clear without any suspended encapsulated particles in it and includes a viscosity range from about 200 centipoise (cP) to about 30,000 cP at standard temperature and pressure. Also, the sprayable gel cleaner has a neutral pH around 7.

In another aspect of the disclosure, provided is a method for cleaning a hydrophobic surface. The method includes the steps of applying a substantially homogeneous high viscosity surface cleaning gel or gel foam composition onto the hydrophobic surface from a dispenser such that the composition is arranged in an applied pattern. The composition comprises about 70% to about 99% of a liquid carrier and about 0.002% to about 10% of a surfactant selected from the group of non-ionic, anionic, amphoteric, and zwitterionic surfactants, and mixtures thereof. The composition further includes about 0.005% to about 5% of a water-soluble polymeric thickening agent and about 0.001 to about 1.0% of a pH balancing agent. The composition is clear without any suspended encapsulated particles and has a neutral pH around 7.

The composition is distributed along at least a desired portion of the hydrophobic surface in a distributed pattern using pliable soft cloth, tissue paper or micro-fiber cloth. The composition is then removed from the hydrophobic surface along with any associated contaminants thereon, by dry part of the soft cloth or microfiber cloth till it is completely clean.

DETAILED DESCRIPTION

In one preferred embodiment of the present disclosure involves a cleaning composition and method for cleaning delicate hydrophobic surfaces. The disclosure includes the delivery of a sprayable gel or gel foam cleaner for cleaning optical or electronic device surfaces. The cleaner is particularly directed for use with hydrophobic surfaces on certain optical lenses as well as electronic surfaces such as touch-screens, digital displays, computer monitors, television screens, tablet displays and telephone displays. Notably, hydrophobic surfaces repel water and other liquids such that as the water or liquid comes in contact with the surface, the water beads up to create small droplets and rolls off the surface. The gel or gel foam cleaner of the present disclosure cleans and dwells for extended time on these surfaces, makes better contact with the surfaces and thereby cleans the surfaces better. Hydrophobic surfaces typically include a contact angle between 40 degrees to 120 degrees.

The sprayable gel cleaner composition of the present invention is prepared by mixing from about 80% to about 90% of a carrier liquid as primary solvent; the carrier liquid may be water, alcohol or mixtures thereof; the alcohols used in the liquid carrier include lower alkyl alcohols such as methanol, ethanol, isopropyl and tert-butyl alcohol and mixtures thereof; from about 0.002% to about 10% of a surfactant selected from the group of nonionic, anionic, amphoteric, and zwitterionic surfactants and mixtures of the above; from about 0.005% to about 5% of a water-soluble polymeric thickening agent; from about 0.001% to about 0.5% of a pH balancing agent and optionally, small amount of fragrance and/or color. In this preferred embodiment, the sprayable gel cleaner compositions are completely clear and have a viscosity range from about 4,000 cP to about 8,000 cP at standard room temperature and pressure.

Figure 1:
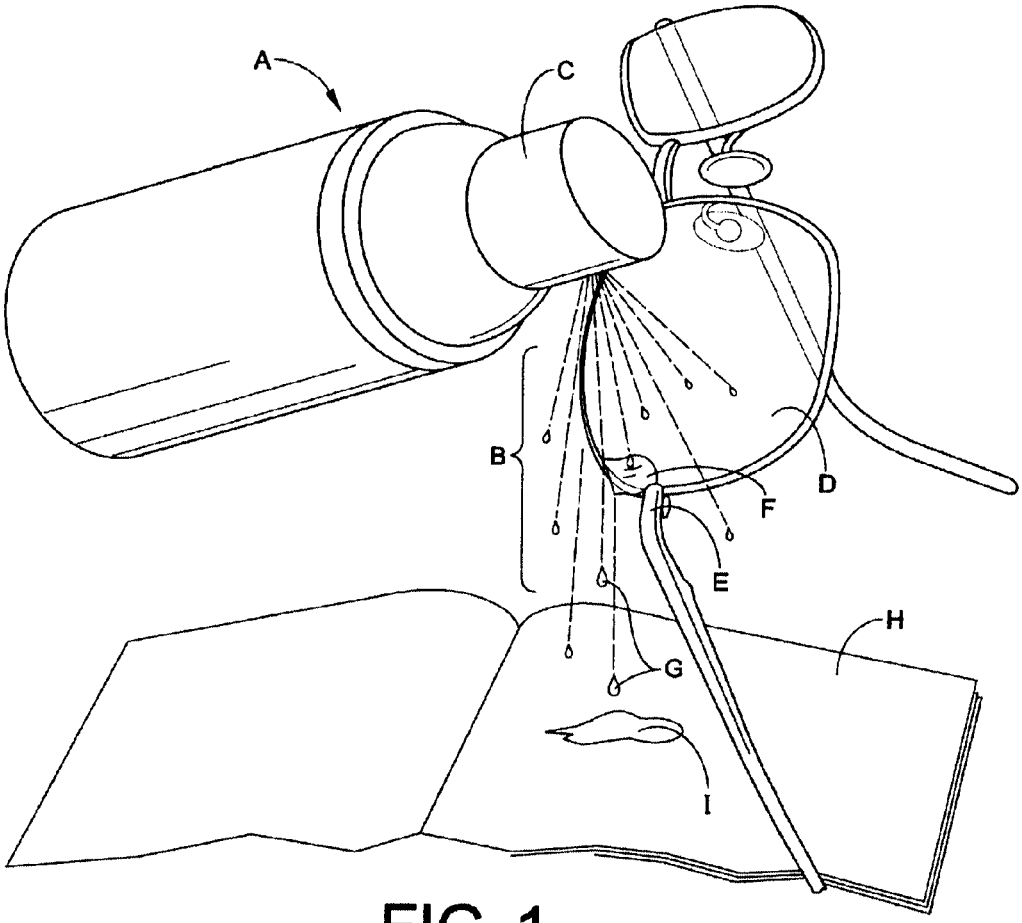
FIG. 1 (Prior Art)
FIG. 1 is a perspective view of a prior art spray bottle dispenser dispensing a liquid cleaner as a spray on a pair of eyeglass lenses.
Figure 2:
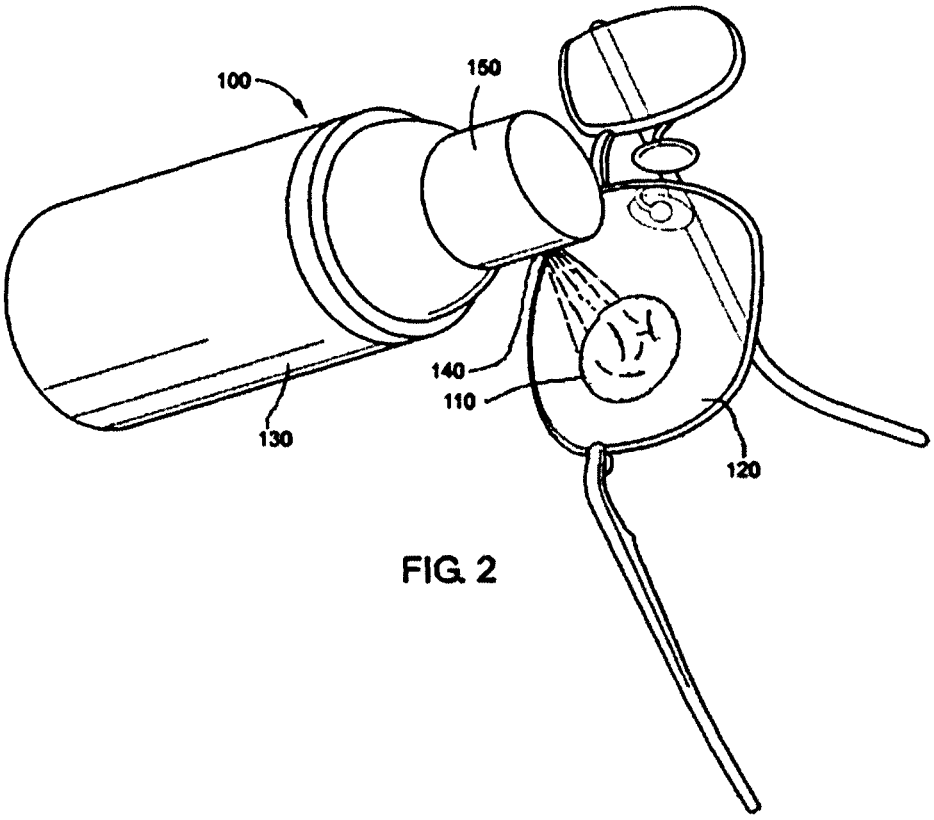
FIG. 2 is a perspective view of one embodiment of a gel cleaner composition in a spray bottle dispenser dispensing a gel cleaner on a pair of eyeglass lenses.

As illustrated by FIG. 2, the gel cleaner composition 110 can be packed in a reservoir 130 of a dispenser such as a spray bottle 100 for use. To clean an optical lens 120 or an electronic surface, the gel cleaner 110 is sprayed on the surface 120 by pressing on a sprayer 150 thereby dispensing the gel 110 through a nozzle 140. The gel cleaner 110 is applied to the surface in an applied pattern and is adapted to cling and dwell longer on the surface of the lens 120 or the electronic device than a liquid cleaner.

Figure 3:
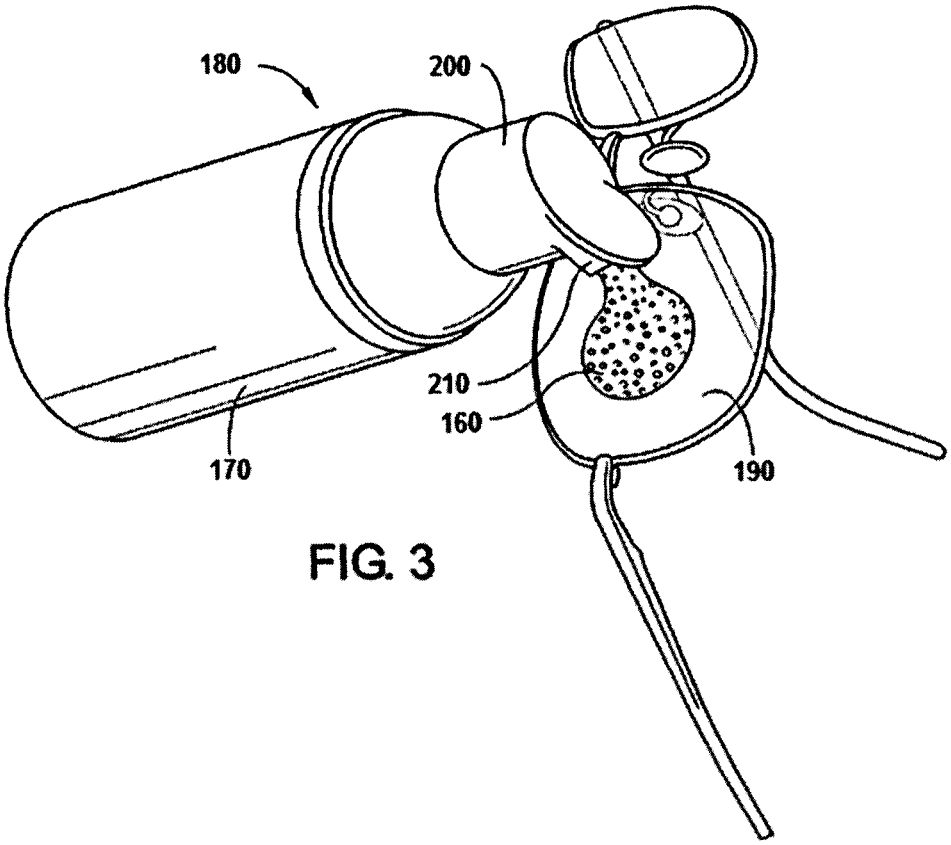
FIG. 3 is a perspective view of another embodiment of a gel foam cleaner composition dispenser dispensing the gel foam cleaner as a foam on a eyeglass lens surface.

As illustrated by FIG. 3, the gel foam cleaner composition 160 can be packed in a reservoir 170 of a dispenser such as a foam pump 180 for use. To clean an optical lens 190 or an electronic surface, the gel foam cleaner 160 is dispensed on the surface 190 by pressing on a pump head 200 thereby dispensing the gel foam 160 through a nozzle 210. The gel foam cleaner 160 is applied to the surface in an applied pattern and is adapted to cling and dwell longer on the surface of the lens 190 or the electronic device than a liquid cleaner.

With the help of a soft cloth or tissue paper, the gel cleaner is distributed about the optical lens surface or the electronic device surface in a distributed pattern to make substantial contact along a desired portion of the surface. The distributed pattern can be the entire surface or merely a small section of the surface. In one embodiment, a pliable, non-scratch material is used to distribute the composition along the desired portion of the hydrophobic surface. The pliable, non-scratch material can be a lint free tissue paper, soft cloth or a microfiber cloth that is commonly known in the art. The pliable, non-scratch material can also be employed to remove the gel cleaner and any contaminants from the surface till it is clean and free from any streak marks.

The gel or gel foam cleaner includes a high viscosity that does not drip from the surface or flow down as does a liquid type cleaner. It also makes good contact with the surface thereby giving a better cleaning without risk of scratching the surface. Notably, the term "substantially homogeneous" as it is used herein is desired to mean a substantially homogeneous material on a macroscopic level, i.e., on a scale detectable by a human naked eye.

It is therefore one object of the invention to provide a variety of substantially homogeneous gel and gel foam cleaner compositions without any suspended encapsulated particles. The compositions include different viscosities and are adapted to be readily dispensed using conventional dispensers such as a pressure actuated sprayer, a trigger type hand sprayer, a foam pump or a squeezable tube. Contemplated foam pump dispensers include both aerosol and non-aerosol type dispensers.

In one embodiment, the gel cleaner composition may include a carrier liquid that contains surfactants selected from the group of nonionic, ionic, amphoteric, and zwitterionic surfactants and mixtures of the same. The composition may further contain water soluble polymeric thickening agents and a certain amount of pH balancing agents. The gel or gel foam cleaner composition can have a viscosity range from about 200 cP to about 30,000 cP. In some instances, the gel or gel foam cleaner composition has a viscosity range from about from about 2,000 cP to about 20,000 cP, preferably from about 4,000 cP to about 15,000 cP and most preferably from about 5,600 cP to about 10,000 cP. These viscosity ranges are contemplated at room temperature and pressure.

The above embodiment of the gel cleaner composition may further comprise a small amount of one supplemental low boiling solvent for dissolving oil based particles in water. The low boiling solvent could be lower alkyl alcohols such as methanol, ethanol, isopropyl and tert-butyl alcohols.

Furthermore, additional embodiments can be contemplated which may, optionally, include other additives such as, e.g., anti-static agents, anti-fog agents, a fragrance or a color.

In another disclosure, the gel or gel foam cleaner composition may comprise from about 70% to about 99% of a carrier liquid; from about 0.002% to about 10% of surfactants selected from the group of nonionic, anionic, amphoteric, and zwitterionic surfactants and mixtures of the above; from about 0.005% to about 5% of a water-soluble polymeric thickening agents; from about 0.001% to about 1.0% of a pH balancing agents and optionally, small amount of fragrance and or color. In the present invention the gel cleaner composition has a viscosity from about 200 cP to about 30,000 cP and can be housed in a simple spray bottle. Furthermore, the sprayable gel cleaner composition substantially clings to and dwells on the surface for a long time at room temperature and pressure. To clean the surface of an article the gel cleaner composition is sprayed or applied using the simple finger sprayer or trigger sprayer. The gel cleaner composition is distributed along a desired portion of the surface using a wiping cloth or soft tissue paper or micro-fiber cloth in a distributed pattern. The gel or gel foam cleaner composition is removed from the surface using a wiping cloth or tissue paper or micro-fiber cloth that also removes any unwanted particulate and leaves behind a completely clean surface.

The gel cleaner composition of the present invention may also have from about 0.01% to about 5% of anti-static agents and or from 0.1% to about 10% of an anti-fog agents added to it. Application of the gel cleaner composition on the surface followed by distributing and removing off the composition from the surface leaves behind a clean surface with anti-static and or anti-fog properties on the surface. As such, and in accordance with the present invention, a novel substantially homogeneous and high viscosity gel or gel foam cleaner intended for delicate surface cleaning such as hydrophobic optical lens and electronic surfaces is disclosed. The high viscosity gel cleaner composition can be formulated for no-drip, high cling time and longer dwelling on the surface. In addition a safe and homogeneous sprayable gel cleaner composition having no suspended insoluble particles in it, having no ammonia or glycol ether solvents in it and having an extended clinging and dwell time when sprayed on to an optical lens or an electronic surface to be cleaned (as compared to low viscosity liquid spray cleaner) has been disclosed. As provided above, the present sprayable gel cleaner composition may have variable viscosity and could be dispensed by a simple spray applicator. The sprayable gel cleaner composition may also include a liquid carrier that is a pure water or a mixture of water and lower alkyl alcohols having from about 0.001% to about 0.1% of a water soluble color. Other additives can include anti-static agents, anti-fog agents and fragrance.

As evidence of the time it takes the gel and gel foam compositions to travel a pre-determined distance along selected hydrophobic surfaces, compared to a liquid cleaner, several experiments have been conducted. In a first experiment, the gel cleaner, the gel foam cleaner and a common liquid cleaner were applied to several common types of electronic devices including a tablet display, a push button smart phone, a touch screen smart phone, and a computer monitor. Generally, the water contact angle for the hydrophobic surface on these devices is approximately 60-90 degrees. Each of the devices were configured in an angled orientation having an angle between 45 and 90 degrees from the ground allowing the applied cleaners to run down the angled hydrophobic surface. In each recorded event, a user applied the cleaner with a dispenser from approximately 2 inches away from the surface. In case of gel foam cleaner, it was delivered very close to the surface by the foam pump dispenser. Each cleaner was timed from the point of application until a bottom portion of the cleaner rolled 2.5 inches from the application pattern. The results are of an average of three (3) readings in each case as listed in Table 1:

TABLE 1

| Surface | Run Distance (Inches) | Gel Cleaner/Time (Avg. Seconds) | Gel Foam Cleaner/ Time (Avg. Seconds) | Liquid Cleaner/ Time (Avg. Seconds) |
|---|---|---|---|---|
| Tablet display | 2.5 | 58 | 32.9 | 1 |
| Push Button Smart Phone | 2.5 | 166.16 | 64.3 | 1 |
| Touch Screen Smart Phone | 2.5 | 103.6 | 61 | 1 |
| Computer Monitor | 2.5 | >180 | 79.6 | 1 |

Additionally, in a second experiment, the gel cleaner, the gel foam cleaner and the common liquid cleaner were applied to several common brands of anti-reflective lenses. Generally, the contact angle for a substrate such as an anti-reflective hydrophobic lens is approximately 90-115 degrees. Eight different brands of lenses were tested whereas each of the surfaces included 70 mm round lens type with six base curvature. The lenses were angled between 45 and 90 degrees from the ground to provide an angled surface and allow each of the cleaners to run thereon. In each recorded event, the liquid and gel cleaner were applied by a spray dispenser in an applied pattern to the top of each lens from approximately 2 inches away from the surface. In case of the gel foam cleaner, it was applied on the surface using foam pump. Each cleaner was timed from the point of application until a bottom portion of the cleaner rolled 2 inches from the applied pattern. The results are of an average of three (3) readings in each case as listed in Table 2:

TABLE 2

| Anti-Reflective Lens | | | | |
|---|---|---|---|---|
| Surface | Run Distance (Inches) | Gel Cleaner/Time (Avg. Seconds) | Gel Foam Cleaner/Time (Avg. Seconds) | Liquid Cleaner/ Time (Avg. Seconds) |
| Brand 1 | 2 | 15.6 | 26.6 | 1 |
| Brand 2 | 2 | 18.6 | 33 | 1 |
| Brand 3 | 2 | 15.3 | 33.6 | 1 |
| Brand 4 | 2 | 22.6 | 28.6 | 1 |
| Brand 5 | 2 | 22 | 28 | 1 |
| Brand 6 | 2 | 20.3 | 24 | 1 |
| Brand 7 | 2 | 33.6 | 28.3 | 1 |
| Brand 8 | 2 | 51 | 39.6 | 1 |

Finally, in a third experiment, the gel cleaner, the gel foam cleaner and the common liquid cleaner were applied to several common types of non-anti-reflective plastic lenses, 70 mm round lens type with six base curvature. Generally, non-anti-reflective lenses have a water contact angle of approximately 40-50 degrees. Each of the surfaces were angled between 45 and 90 degrees from the ground to provide an angled surface and allow the cleaners to run thereon. In each recorded event, the liquid and gel cleaner were applied by a spray dispenser in an applied pattern to the top of each lens from approximately 2 inches away from the surface. In case of the gel foam cleaner, it was applied on the surface using foam pump and close to the surface. Each cleaner was timed from the point of application until a bottom portion of the cleaner rolled 2 inches from the applied pattern. The results are of an average of three (3) readings in each case as listed in Table 3:

TABLE 3

| Non-Anti-Reflective Lens | | | | |
|---|---|---|---|---|
| Surface | Run Distance (Inches) | Gel Cleaner/Time (Avg. Seconds) | Gel Foam Cleaner/ Time (Avg. Seconds) | Liquid Cleaner/ Time (Avg. Seconds) |
| CR-39* | 2 | >180 | 39.6 | 1 |
| Polycarbonate | 2 | 116 | 47 | 1 |
| High Index | 2 | 95.3 | 52.6 | 1 |

*Registered Trademark of PPG Industries Plastics.

One can appreciate that the liquid cleaner experienced a rapid run time when compared to the gel and gel foam cleaners for each of the hydrophobic surfaces tested. Notably, the common dwell time for the liquid cleaners to travel both the 2 inch distance and the 2.5 inch distance was at most 1 second. However, the gel and gel foam cleaners experienced a substantially different and very slow average rate of travel along the hydrophobic surfaces.

The gel and gel foam cleaning compositions cling to and dwell on each of the hydrophobic surface for substantially longer relative period of time than the liquid cleaner. The gel compositions were shown to drip, bead up or flow down a distance at a rate between 20 seconds and 180 seconds, much slower than it takes a low viscosity liquid composition to drip, bead up or flow down the same distance.

From these experiments, it becomes clear that the gel and gel foam composition clings to and dwells on a hydrophobic surface such that the composition drips, beads up or flows down a comparable distance at a rate at least twenty (20) times slower than the rate it takes a low viscosity liquid composition to flow down the same distance on the hydrophobic surface.

To compare the cleaning performance difference between the liquid cleaner and the gel or gel foam cleaner for hydrophobic surfaces, all three cleaners in the present invention, were tested at Colt Laboratories, Florida, USA, using their standardized and certified surface cleaning test method called "Oily Cleaning", Test Method No. SOP #23-10-03. The test procedure and data measuring is well explained in the test method and, as such, only general information pertaining thereto will be discussed herein. The performance of the lens cleaner is measured by putting a known amount of WD-40 oil on the surface of the anti-reflective hydrophobic lens and smearing it on the lens surface to make the surface oily and dirty. The lens is held horizontally on a pivot arm of a BYK Gardner Haze-Gard Plus instrument, keeping the convex side of the lens up. A known amount of liquid lens cleaner is then applied on the dirty lens surface via a spray bottle (one full spray stroke). The lens surface is then rubbed with a known soft cloth attached to a moving vertical arm of the instrument. The moving arm is loaded with a known weight, so as to apply a known or constant rubbing pressure on the lens surface. The haze present on the test lens is measured by a haze measuring instrument "Haze Meter" before starting the experiment and is used as a reference. Haze readings are then taken after 20, 40 and 60 rubs of the cloth on the oily lens and a Delta Haze Gain number for the liquid cleaner cleaning performance is determined. A minimum of four lenses are tested for the cleaning performance of the liquid cleaner and an average of the delta haze gain numbers of the four lenses is determined. This number is represented as "Average Haze Gain" number. The above experiment was then repeated, using a new set of four lenses and the sprayable gel cleaner, which is again applied by spray bottle as gel spray on the lens and an "Average Haze Gain" number for cleaning performance of gel cleaner was determined. Lastly, the third set of four lenses were tested using the gel foam cleaner, as the gel foam was applied by foam pump to the lens. Again, an "Average Haze Gain" number for the cleaning performance of gel foam cleaner was determined. The overall cleaning efficiency of the three cleaners was determined by comparing the reference Haze number to the different "Average Haze Gain" numbers. According to the test method used, the lower the "Average Haze gain" number represents a more efficient cleaning or performance. The results are listed in Table 4 and show the "Average Haze Gain" numbers for all three cleaners tested.

TABLE 4

| Haze Gain Numbers for "Oily Cleaning Test" | |
|---|---|
| Cleaners | Average Haze Gain |
| Liquid Lens Cleaner | 0.53 |
| Sprayable Gel Cleaner | 0.07 |
| Gel Foam Cleaner | 0.00 |

Accordingly, the hydrophobic surface cleaning performance test data for the liquid spray cleaner, sprayable gel cleaner and the gel foam cleaner were compared. In the case of the liquid lens cleaner, the "Average Haze Gain" number was found to be 0.53. By comparison, the gel cleaner method gave an "Average Haze Gain" number of 0.07 and the gel foam cleaner method gave an "Average Haze Gain" 0.00. By this experiment, it is very clear that using the liquid lens cleaner to clean a hydrophobic surface leaves a measurable haze as residue on the surface whereas using gel cleaner or gel foam cleaner minimizes or completely reduces the haze residue to zero. The data shows that the gel or gel foam cleaner is a safe and superior cleaning method for hydrophobic surfaces.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A sprayable, homogeneous and high viscosity surface cleaning gel composition, comprising:

about 70% to about 99% of a liquid carrier;

about 0.002% to about 10% of a surfactant selected from the group of nonionic, anionic, amphoteric, and zwitterionic surfactants, and mixtures thereof;

about 0.005% to about 5% of a water-soluble polymeric thickening agent; and about 0.001 to about 1.0% of a pH balancing agent, wherein the sprayable gel cleaner composition is clear without any suspended encapsulated particles and has a viscosity range from about 200 centipoise to about 30,000 centipoise at room temperature and pressure;

wherein the cleaning gel composition has a pH of 7.

2. The sprayable gel cleaner composition of claim 1, wherein the liquid carrier is pure water.

3. The sprayable gel cleaner composition of claim 1, wherein the liquid carrier is a mixture of water and lower alkyl alcohols.

4. The sprayable gel cleaner composition of claim 1, having from about 0.001% to about 0.1% of a water soluble color.

5. The sprayable gel cleaner composition of the claim 1, having from about 0.001% to about 0.5% of a fragrance.

6. The sprayable gel cleaner composition of claim 1, having from about 0.01% to about 5% of anti-static agents.

7. The sprayable gel cleaner composition of claim 1, having from about 0.1% to about 10% of anti-fog agents.

8. The sprayable gel cleaner of claim 1, wherein the gel cleaner composition has a viscosity range from 5,600 cP to about 10,000 cP at room temperature and pressure.

9. A method for cleaning a hydrophobic surface comprising:

applying a substantially homogeneous high viscosity surface cleaning gel composition in accordance with claim 1 onto the hydrophobic surface from a dispenser in an applied pattern;

distributing the composition along at least a desired portion of the hydrophobic surface in a distributed pattern; and removing the composition along with associated contaminants from the hydrophobic surface.

10. The method for cleaning a hydrophobic surface of claim 9, wherein the composition is applied or distributed onto the hydrophobic surface configured in an angled orientation wherein the composition clings to and dwells in the applied pattern or distributed pattern, respectfully at room temperature and pressure.

11. The method for cleaning a hydrophobic surface of claim 10, wherein the composition clings to and dwells on the hydrophobic surface such that the composition drips, beads up or flows down a distance at a rate at least twenty (20) times slower than the rate it takes a low viscosity liquid composition to flow down the same distance on the hydrophobic surface.

12. The method for cleaning a hydrophobic surface of claim 9 wherein the hydrophobic surface comprises an optical lens including eyeglasses, sun and sports lenses, safety lenses, camera lenses, microscope lenses, telescope lenses or an electronic surface such as a touch screen, digital display, computer monitor, television screen, tablet display or telephone display.

13. A method for cleaning a hydrophobic surface comprising:

applying a substantially homogeneous high viscosity surface cleaning gel foam composition onto the hydrophobic surface from an aerosol or non-aerosol foam pump dispenser such that the composition is arranged in an applied pattern as foam, the composition comprising:

about 70% to about 99% of a liquid carrier;

about 0.002% to about 10% of a surfactant selected from the group of nonionic, anionic, amphoteric, and zwitterionic surfactants, and mixtures thereof;

about 0.005% to about 5% of a water-soluble polymeric thickening agent; and about 0.001 to about 1.0% of a pH balancing agent, wherein the composition is clear without any suspended encapsulated particles;

distributing the composition along at least a desired portion of the hydrophobic surface in a distributed pattern; and removing the composition along with any associated contaminants from the hydrophobic surface;

wherein the cleaning gel foam composition has a pH of 7.

14. The method for cleaning a hydrophobic surface of claim 13, wherein the composition is applied or distributed onto the hydrophobic surface configured in an angled orientation wherein the composition clings to and dwells in the applied pattern or distributed pattern, respectfully at room temperature and pressure.

15. The method for cleaning a hydrophobic surface of claim 14, wherein the composition clings to and dwells on the hydrophobic surface such that it drips, beads up or flows down a distance between 20 seconds and 180 seconds slower than it takes a low viscosity liquid composition to drip, bead up or flow down the same distance.

16. The method for cleaning a hydrophobic surface of claim 13, wherein the dispenser is a spray bottle such as a trigger type or pressure activated type, a foam pump such as an aerosol or non-aerosol type, a squeezable tube or a flexible pouch.

17. The method for cleaning a hydrophobic surface of claim 13, wherein the compositions includes a viscosity range from about 200 cP to about 30,000 cP at room temperature and pressure.

18. The method for cleaning a hydrophobic surface of claim 17, wherein the composition includes a viscosity range from about 4,000 cP to about 15,000 cP at room temperature and pressure.

19. The method for cleaning a hydrophobic surface of claim 13, wherein the composition is distributed along at least a portion of the hydrophobic surface with a pliable, non-scratch material such as lint free soft tissue, soft cloth or micro-fiber cloth into the distribution pattern.

20. The method for cleaning a hydrophobic surface of claim 13, wherein the composition is removed from the hydrophobic surface with a pliable, non-scratch material.

21. The method for cleaning a hydrophobic surface of claim 13 wherein the hydrophobic surface comprises an optical lens including eyeglass lenses, sun and sports lenses, safety lenses, camera lenses, binocular lenses, microscope lenses, telescope lenses or an electronic surface such as a touch screen, digital display, computer monitor, television screen, tablet display or telephone display.

* * * * *